US007323810B2

(12) United States Patent
Orjela et al.

(10) Patent No.: US 7,323,810 B2
(45) Date of Patent: Jan. 29, 2008

(54) SPARK PLUG FOR AN INTERNAL COMBUSTION ENGINE

(76) Inventors: Gurdev Orjela, 56, Rue De L'eau, Autelbas Barnich, Arlon (BE) B-6700; Paul Tinwell, 23 St. Catherines Drive, Hartford, Northwich, Cheshire (BE) CW8 2FE ( * ) Notice: Subject to any disclaimer, the term of this patent is extended or adjusted under 35 U.S.C. 154(b) by 286 days.

(21) Appl. No.: 10/486,962

(22) PCT Filed: Aug. 15, 2002

(86) PCT No.: PCT/EP02/09275

§ 371 (c)(1),
(2), (4) Date: Feb. 12, 2004

(87) PCT Pub. No.: WO03/019746

PCT Pub. Date: Mar. 6, 2003

(65) Prior Publication Data

US 2004/0239224 A1 Dec. 2, 2004

(30) Foreign Application Priority Data

Aug. 23, 2001 (EP) ..... 01000403

(51) Int. Cl.
*H01T 13/20* (2006.01)
*H01T 1/22* (2006.01)
*H01T 21/02* (2006.01)

(52) U.S. Cl. ..... 313/141; 313/143; 313/144; 445/7

(58) Field of Classification Search ..... 313/141–143; 445/7

See application file for complete search history.

(56) References Cited

U.S. PATENT DOCUMENTS

| | | | | |
|---|---|---|---|---|
| 5,273,474 | A * | 12/1993 | Oshima et al. | 445/7 |
| 5,320,569 | A | 6/1994 | Oshima et al. | |
| 5,347,193 | A | 9/1994 | Oshima et al. | |
| 5,811,915 | A | 9/1998 | Abe et al. | |
| 5,982,080 | A * | 11/1999 | Shibata et al. | 313/141 |
| 6,093,071 | A | 7/2000 | Osamura et al. | |
| 6,094,000 | A | 7/2000 | Osamura et al. | |
| 6,147,441 | A | 11/2000 | Osamura | |
| 6,215,234 | B1 * | 4/2001 | Abe et al. | 313/141 |
| 6,262,522 | B1 | 7/2001 | Osamura et al. | |
| 6,346,766 | B1 * | 2/2002 | Kanao et al. | 313/141 |

FOREIGN PATENT DOCUMENTS

| | | | |
|---|---|---|---|
| EP | 1139530 | A2 * | 10/2001 |
| JP | 09106879 | A * | 4/1997 |
| WO | WO 2006008659 | A2 * | 1/2006 |

* cited by examiner

*Primary Examiner*—Mariceli Santiago
(74) *Attorney, Agent, or Firm*—Reising, Ethington, Barnes, Kisselle, P.C.

(57) ABSTRACT

A spark plug for an internal combustion engine comprising a centre electrode and an earth electrode serving as a spark discharge section, as well as a noble metallic chip, which is inserted into one end of at least one of said electrodes along part of its length and which is subsequently welded thereto by irradiation with energy-condensing light, characterized in that said noble metallic chip is provided with a profile for holding said noble metallic chip onto said at least one electrode on at least part of the outer periphery of said part of its length, wherein a fusion layer extending between said profile and an inner region of the end of said at least one electrode locks said noble metallic chip onto said at least one electrode.

15 Claims, 2 Drawing Sheets

SPARK PLUG FOR AN INTERNAL COMBUSTION ENGINE

Figure 1:
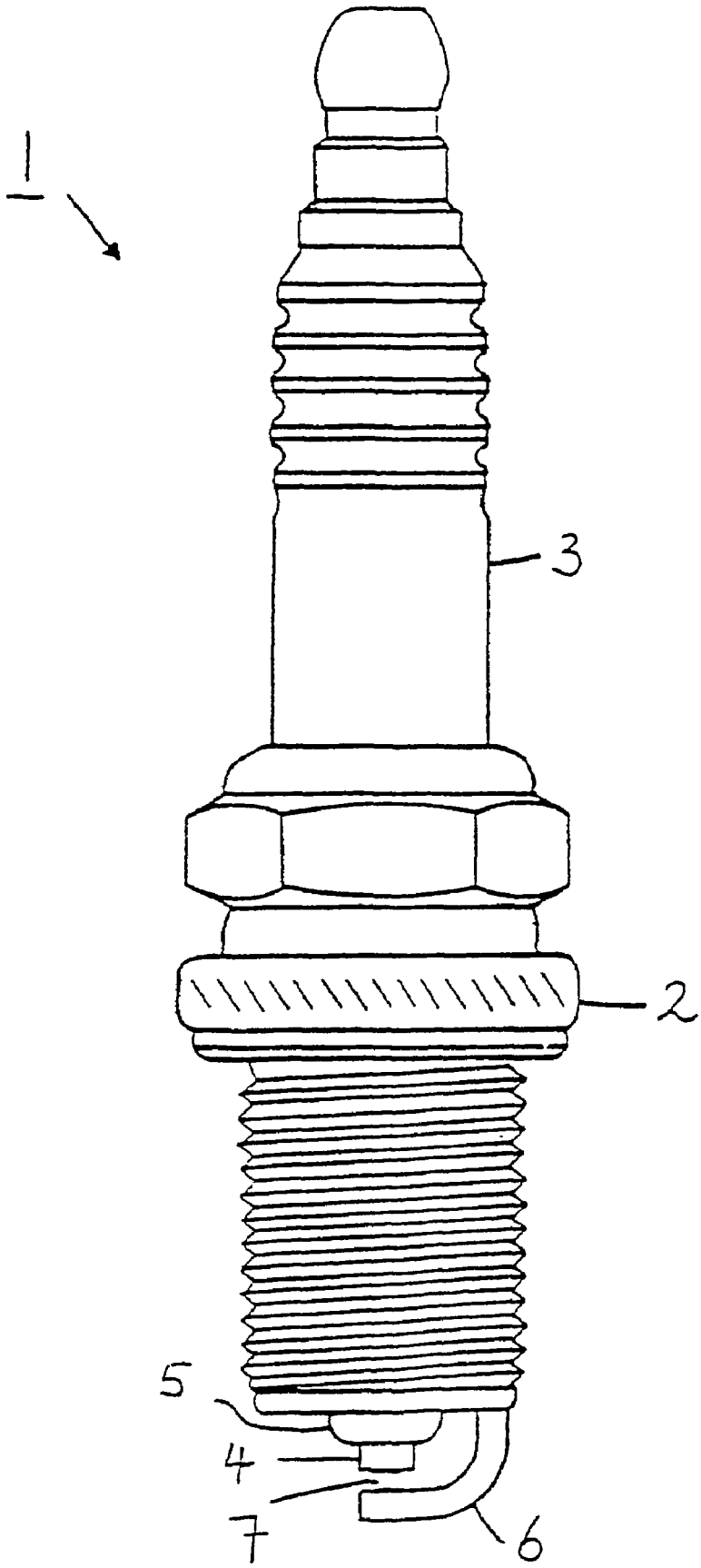

The invention relates to a spark plug for an internal combustion engine, comprising a centre electrode and an earth electrode serving as a spark discharge section, as well as a noble metallic chip, which is inserted into one end of at least one of said electrodes along part of its length and which is subsequently welded thereto by irradiation with energy-condensing light. The invention also relates to a method for manufacturing the spark plug.

Such a spark plug is known from German patent publication no. 2,224,270 (Robert Bosch). In this prior art spark plug, a noble metallic chip is equipped with an enlarged bottom part to be placed into a pre-formed rectangular bore of an end of a centre electrode. By irradiating said bore with energy-condensing light while the enlarged bottom part of the noble metallic chip is present therein, side walls of the bore will melt and will positively lock (German: "formschlüssen") the noble metallic chip onto the centre electrode. Before irradiating and thereby melting the sidewalls of the bore, the noble metallic chip is covered with a special layer in order to avoid fusion between the noble metallic chip and the centre electrode of the spark plug. The noble metal such as a platinum-based alloy serves to import spark erosion resistance to the front end of the centre electrode.

A drawback of the spark plug known from the aforesaid German patent document is that in practice the connection between the noble metallic chip and the central electrode has appeared not to be very reliable, with all its disadvantages, as thermal stresses in the melted area between the sidewalls of the bore of the central electrode and the noble metallic chip will reduce the strength of the connection between the central electrode and the noble metallic chip. Besides, inclusions formed during melting of the sidewalls of the bore will reduce the strength of the connection as well.

The object of the invention is to overcome the above drawback of the prior art and in particular, to provide a spark plug having a reliable connection between the central electrode and/or the earth electrode on the one hand and the noble metallic chip on the other hand, in order to enhance the durability of the spark plug.

In order to accomplish that objective, a spark plug of the type mentioned in the preamble is according to the invention characterized in that said noble metallic chip is provided on at least part of an outer periphery of said part of its length with a profile for holding said noble metallic chip onto said at least one electrode, wherein a fusion layer extending between said profile and an inner region of the end of said at least one electrode locks said noble metallic chip onto said at least one electrode. In other words, the profiled outer surface of the part of the noble metallic chip which is inserted into the end of the central electrode and/or the earth electrode and which cooperates with the fusion layer that is formed by irradiating the connecting surface between the noble metallic chip and the central electrode and/or the earth electrode with energy-condensing light, ensures a sufficiently strong connection in the welded area between the noble metallic chip and the central electrode and/or the earth electrode. The profile also implicates a less costly spark plug, as less noble metal is used. The profile in principle could have any form, i.e. could comprise holes, slots, grooves, etcetera.

In one preferred embodiment of a spark plug in accordance with the invention, said noble metallic chip is forcibly pressed into the end of said at least one electrode This has the advantage that a less costly spark plug is obtained: in the case of a spark plug as described in the aforesaid German patent publication, a bore has to be formed, which in itself is cost-increasing, but also a larger amount of noble metallic material has to be used, as the total amount of noble metallic material is determined by the amount required for the spark discharge section and the amount sunk into the bore of the central electrode.

In another preferred embodiment of a spark plug according to the invention, said noble metallic chip is inserted into a pre-formed cavity in the end of said at least one electrode. Although, as already admitted, such a spark plug would be more costly, the use of a pre-formed cavity has this advantage that the noble metallic chip can be inserted into the end of said at least one electrode in a more controllable and reliable manner, without the formation of protruding portions around the outer periphery of the noble metallic chip which would occur when forcibly pressing the latter into said end.

In another preferred embodiment of a spark plug in accordance with the invention, said fusion layer comprises part of said noble metallic chip and part of said at least one electrode, which are fused and mixed with each other. The noble metallic chip and said at least one electrode are effectively mixed in this fusion layer by irradiating the connecting surface between the noble metallic chip and said at least one electrode with energy-condensing light. The irradiation is preferably carried out by laser welding along the entire outer periphery of the noble metallic chip, which is done by rotating the central electrode and/or the earth electrode about its axis. In the alternative, said fusion layer comprises (preferably consists of) fused material of said at least one electrode not being mixed with material of said noble metallic chip. In another preferred embodiment said fusion layer comprises (preferably consists of) another fused separate material.

In another preferred embodiment of a spark plug according to the invention, said profile comprises at least one groove. The at least one groove particularly has an at least substantially V-shaped cross section. In another preferred embodiment, said profile comprises at least one hole.

In another preferred embodiment of a spark plug in accordance with the invention, said noble metallic chip is made of a noble metallic material selected from the group consisting of Ir, Ir-Pt, Ir-Pt-Ni, Ir-Rh, Ir-W, Ir-Al, Ir-Si, Ir-Y, Ir-$Y_2O_3$, Pt-W, Pt-Ir-Rh and wherein said at least one electrode is made of a Ni-group heat-resistant alloy.

As already indicated above, the present invention also relates to a method for manufacturing a spark plug according to the invention, comprising the steps of

- forming a profile on at least part of an outer periphery of a noble metallic chip, along part of the length thereof;
- introducing said noble metallic chip, along said part of its length, into one end of at least either one of a centre electrode and an earth electrode serving as a spark discharge section;
- welding said noble metallic chip onto said at least one electrode by irradiation with energy-condensing light, so that a fusion layer extending between said profile and an inner region of the end of said at least one electrode is formed, whereby said noble metallic chip is locked onto said at least one electrode.

In one-preferred embodiment of a method in accordance with the invention, said method further comprises the steps of

- melting the end of said at least one electrode before forcibly pressing said noble metallic chip therein along said part of its length, or pre-forming a cavity into the end of said at least one electrode before inserting said noble metallic chip therein along said part of its length.

The invention will be explained in more detail hereafter with reference to figures illustrated in a drawing, wherein FIG. 1 is a schematic view showing a spark plug for an internal combustion engine according to the invention; and FIGS. 2*a* through 2*c* relate to a longitudinal section of several preferred embodiments of a noble metallic chip as used in a spark plug of FIG. 1.

Referring to FIG. 1, a spark plug 1 includes an outer shell 2, an insulating core 3, a firing centre electrode 4 extending from an insulating core nose 5, and an earth electrode 6 extending from the outer shell 2. The firing centre electrode 4 and the earth electrode 6 define a spark gap 7. As will be described in more detail hereunder, the firing centre electrode 4 and/or earth electrode 6 has/have a precious metallic chip inserted into the free end thereof. This provides a higher-quality spark during the entire life of the spark plug 1, because the precious metal is highly resistant to spark erosion and corrosion.

Figure 2:
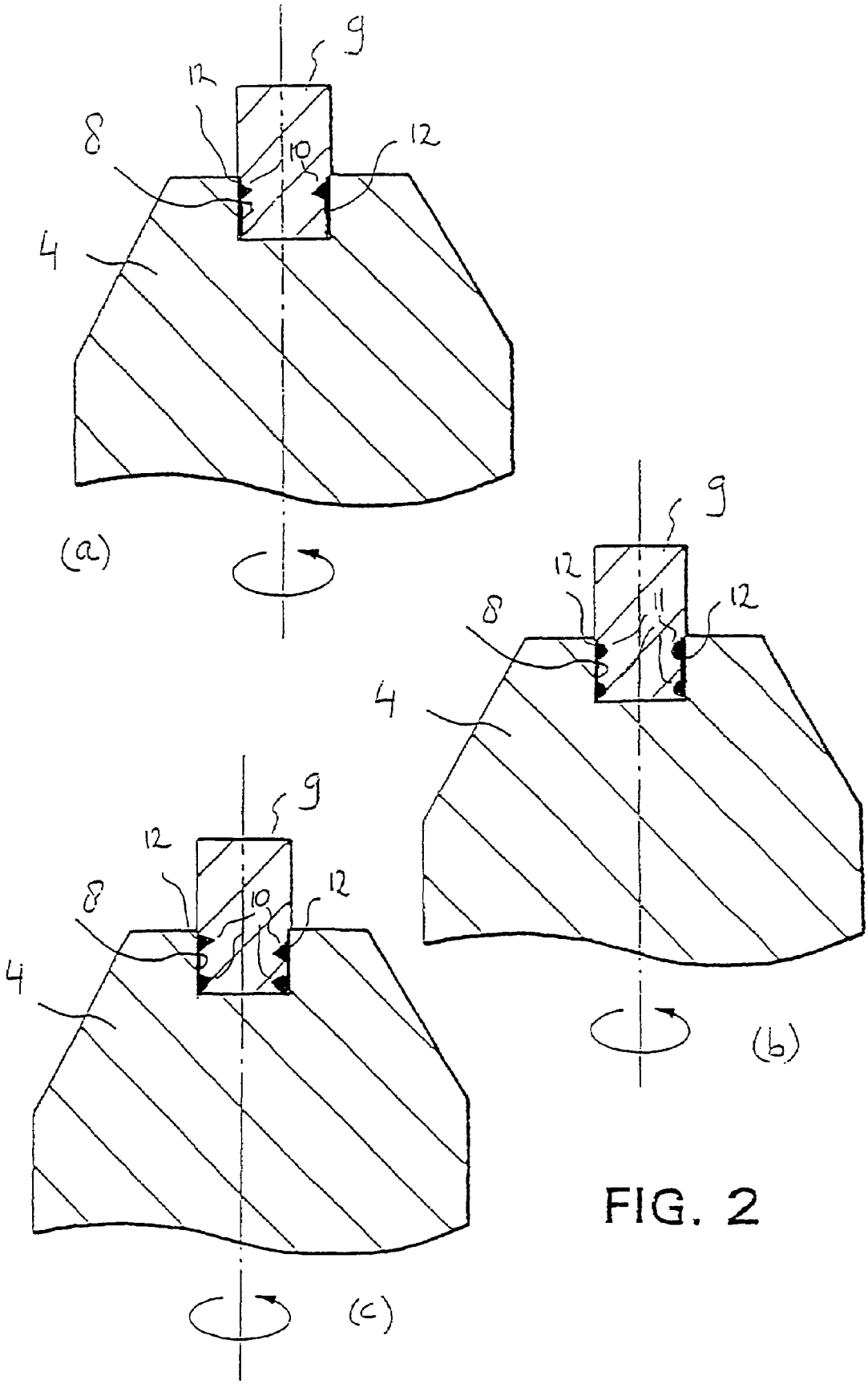

FIGS. 2*a* and 2*b* show a schematic longitudinal section of the free end of the firing centre electrode 4 of the spark plug of FIG. 1. In that free end a cavity 8 has been formed, wherein subsequently a precious metallic chip 9 has been inserted. Before entering the cavity 8, the outer periphery of the precious metallic chip 9 is provided over a part of its length with slots 10 (FIG. 2*a*) and/or holes 11 (FIG. 2*b*). A fusion layer 12, which is indicated in black lines, includes part of said precious metallic chip 9 and part of the firing centre electrode 4 which are fused and mixed with each other. The precious metallic chip 9 and the firing centre electrode 4 are effectively mixed in this fusion layer 12 by irradiating the connecting surface between the precious metallic chip 9 and the firing centre electrode 4 with energy-condensing light. Said irradiation is preferably carried out by laser welding along the entire outer periphery of the precious metallic chip 9, which is done by rotating the firing centre electrode 4 about its longitudinal axis.

FIG. 2*c* corresponds with FIG. 2*a*, with the difference that the precious metallic chip 9 has been forcibly pressed into the free end of the firing centre electrode 4, as the latter is not provided with a cavity 8 but is pre-melted instead to facilitate insertion of the precious metallic chip 9 therein.

It is noted that the present invention is not restricted to the embodiments as described above, but that also other embodiments are possible, which all fall within the scope of the appended claims.

The invention claimed is:

1. A spark plug for an internal combustion engine, comprising a center electrode and an earth electrode serving as a spark discharge section, as well as a noble metallic chip, which is inserted into one end of at least one of said electrodes along part of its length and which is subsequently attached thereto by irradiation with energy-condensing light, characterized in that said noble metallic chip is provided with a profile having at least one hole, slot or groove formed on at least part of the outer periphery of said part of its length, wherein a localized fusion layer extending between said profile and an inner sidewall region of the end of said at least one electrode cooperates with said profile to thereby lock said noble metallic chip onto said at least one electrode.

2. A spark plug according to claim 1, wherein said noble metallic chip is inserted into a pre-formed cavity in the end of said at least one electrode.

3. A spark plug according to claim 1, wherein said fusion layer comprises part of said noble metallic chip and part of said at least one electrode, which are fused and mixed with each other.

4. A spark plug according to claim 1, wherein said profile consists of at least one groove.

5. A spark plug according to claim 4, wherein said at least one groove has an at least substantially V-shaped cross section.

6. A spark plug according to claim 1, wherein said profile consists of at least one hole.

7. A spark plug according to claim 1, wherein said noble metallic chip is made of a noble metallic material selected from the group consisting of Ir, Ir—Pt, Ir—Pt—Ni, Ir—Rh, Ir—W, Ir—Al, Ir—Si, Ir—Y, Ir—$Y_2O_3$, Pt—W, Pt—Ir—Rh and wherein said at least one electrode is made of a Ni-group heat-resistant alloy.

8. A spark plus for an internal combustion engine, comprising a center electrode and an earth electrode serving as a spark discharge section, as well as a noble metallic chip, which is inserted into one end of at least one of said electrodes along part of its length and which is subseuuently attached thereto by irradiation with energy-condensing light, characterized in that said noble metallic chip is provided with a profile having at least one hole, slot or groove formed on at least part of the outer periphery of said part of its length, wherein a fusion layer extending between said profile and an inner region of the end of said at least one electrode cooperates with said profile to thereby lock said noble metallic chip onto said at least one electrode;

wherein said noble metallic chip is forcibly pressed into the end of said at least one electrode having no pre-formed cavity.

9. A method for manufacturing a spark plug, comprising the steps of:

forming a profile on at least part of an outer periphery of a noble metallic chip along part of the length thereof, said profile having at least one hole, slot or groove;

inserting said noble metallic chip, along said part of its length, into one end of at least either one of a center electrode and an earth electrode serving as a spark discharge section;

attaching said noble metallic chip onto said at least one electrode by irradiation with energy-condensing light, so that a fusion layer extending between said profile and an inner region of the end of said at least one electrode is formed, whereby said noble metallic chip is locked onto said at least one electrode.

10. A method according to claim 9, further comprising the steps of melting the end of said at least one electrode before forcibly pressing said noble metallic chip therein along said part of its length, or pre-forming a cavity into the end of said at least one electrode before inserting said noble metallic chip therein along said part of its length.

11. A method according to claim 9, wherein said attaching step further comprises forming said fusion layer entirely from a portion of said at least one electrode.

12. A method according to claim 9, wherein said attaching step further comprises forming said fusion layer using material from said at least one electrode without mixing said electrode material with any material from said noble metallic chip.

13. A method according to claim 9, wherein said attaching step further comprises welding said noble metallic chip onto said at least one electrode.

14. A spark plug for an internal combustion engine, comprising a center electrode and an earth electrode serving as a spark discharge section, as well as a noble metallic chip, which is inserted into one end of at least one of said electrodes along part of its length and which is subseuuently attached thereto by irradiation with energy-condensing light, characterized in that said noble metallic chip is provided with a profile having at least one hole, slot or groove formed on at least part of the outer periphery of said part of its length, wherein a fusion layer extending between said profile and an inner region of the end of said at least one electrode cooperates with said profile to thereby lock said noble metallic chip onto said at least one electrode;

wherein said fusion layer is entirely formed from part of said at least one electrode.

15. A spark plug for an internal combustion engine, comprising a center electrode and an earth electrode serving as a spark discharge section, as well as a noble metallic chip, which is inserted into one end of at least one of said electrodes along part of its length and which is subseuuently attached thereto by irradiation with energy-condensing light, characterized in that said noble metallic chip is provided with a profile having at least one hole, slot or groove formed on at least part of the outer periphery of said part of its length, wherein a fusion layer extending between said profile and an inner region of the end of said at least one electrode cooperates with said profile to thereby lock said noble metallic chip onto said at least one electrode;

wherein said fusion layer does not contain any material from said noble metallic chip.

* * * * *